US005407373A

United States Patent [19]

Allenström

[11] Patent Number: 5,407,373

[45] Date of Patent: Apr. 18, 1995

[54] PROPULSION SYSTEM FOR WATER VESSELS

[75] Inventor: Björn Allenström, Askim, Sweden

[73] Assignee: Bofors Underwater System AB, Motala, Sweden

[21] Appl. No.: 168,536

[22] Filed: Dec. 16, 1993

[30] Foreign Application Priority Data

Dec. 21, 1992 [SE] Sweden ..... 9203847

[51] Int. Cl.[6] ..... B63H 23/24

[52] U.S. Cl. ..... 440/83; 440/67

[58] Field of Search ..... 416/247 A; 440/38, 48, 440/49, 66, 67, 71, 75, 78, 79, 88, 81, 83; 114/337, 20 R, 20 B

[56] References Cited

U.S. PATENT DOCUMENTS 5,185,545 2/1993 Veronesi et al. ..... 440/38

FOREIGN PATENT DOCUMENTS 0425723 5/1991 Germany ..... 440/67

3935754 5/1991 Germany ..... 440/67

*Primary Examiner*—Edwin L. Swinehart

*Attorney, Agent, or Firm*—Oppedahl & Larson

[57] ABSTRACT

A propulsion system for water vessels comprises a rotor located at the rear end of the vessel body, which rotor rotates inside a shroud to generate a propulsion force, and a stator located behind the rotor for recovering the rotation energy created by the rotor. An unexpected high noise reduction is accomplished because the rotor is mounted on a hollow drive shaft, through which an axle extends which is fixed to the body of the vessel, and which axle support the stator and the shroud that surrounds the rotor, without further supporting devices.

2 Claims, 1 Drawing Sheet

PROPULSION SYSTEM FOR WATER VESSELS

TECHNICAL AREA

The present invention refers to a propulsion system for water vessels, comprising a rotor located at the rear end of the vessel's body, which rotor rotates inside a shroud and generates a thrust force, and a stator located behind the rotor for recovering the rotation-energy created by the rotor.

BACKGROUND OF THE INVENTION

Torpedoes and submarines are spool shaped vessels that are propelled below or at the surface by means of propeller drive. To avoid the torpedoes from rotating around its longitudinal axis, they normally need some device for recovering the rotation energy created by the propeller.

Counter rotating propellers have been used to provide propulsion without generation of torque, see e.g. SE 40408. However, the solution is not always acceptable under military circumstances, where nowadays both high speed and silent propulsion are given high priority.

A propulsion system, designed according to the state of art generally designated "pumpjet" system, for torpedoes or submarines is designed according to the introduction of the description, whereby the shroud is supported by a number of supports that extend in different radial directions from the vessel's body. The stator on its part is fixedly mounted in the rear part of the shroud, downstream the rotor.

The supports placed in front of the rotor create interferences in the flow to the rotor. These interferences can cause variations in stress on the rotor blades. The variations in stress produce a striking increase in noise radiating out from the pumpjet system arrangement. Besides, the interferences can cause hydraulic cavitation on the rotor blades, which forms a very strong source of noise, and can damage the surfaces of each blade.

THE TECHNICAL PROBLEM

A purpose of the present invention is to provide a propulsion device that is very silent in comparison with a conventional pumpjet system.

THE SOLUTION

For this purpose, the propulsion device according to the invention is characterized in that the rotor is mounted on a hollow drive shaft, through which an axle extends which is rigidly attached to the vessel's body and supports the stator and the shroud that surrounds the rotor.

DESCRIPTION OF THE DRAWINGS

The invention will be described below with reference to the embodiment shown in the enclosed drawing, wherein.

DESCRIPTION OF EMBODIMENTS

Figure 1:
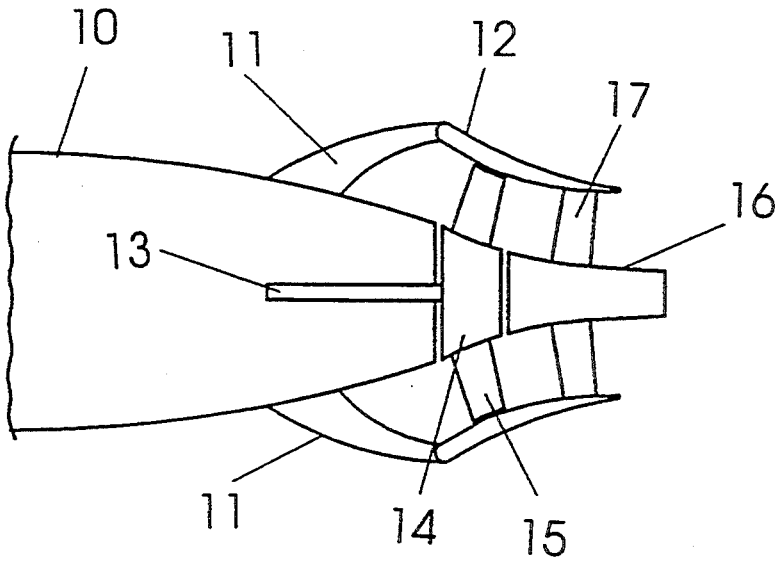
FIG. 1 schematically shows the rear part of a torpedo in a sectional view that is outfitted with a conventional pumpjet system, and FIG. 2 in a corresponding way shows the rear part of a torpedo with a propulsion device designed according to the invention.

FIG. 1 shows, in a broken view, the rear part of a torpedo body 10 that is equipped with a conventional pumpjet system. It includes four backwards sloping supports 11, supporting a shroud 12.

The shroud 12 extends backwards past a rotor with rotor blades 15 mounted onto axle 13 by means of a boss 14, and supports a stator located downstream the rotor. The stator is located at a short distance behind the rotor and includes a stator hub 16, which forms a hydrodynamic advantageous designed extension of the boss 14, and a number of stator wings 17. These are developed so that the rotation that arises in the water at the passage of the rotor, and which creates torque that endeavor to twist the torpedo body, said rotation is captured and converted into a backwards pointing stream counteracting said torque.

Figure 2:
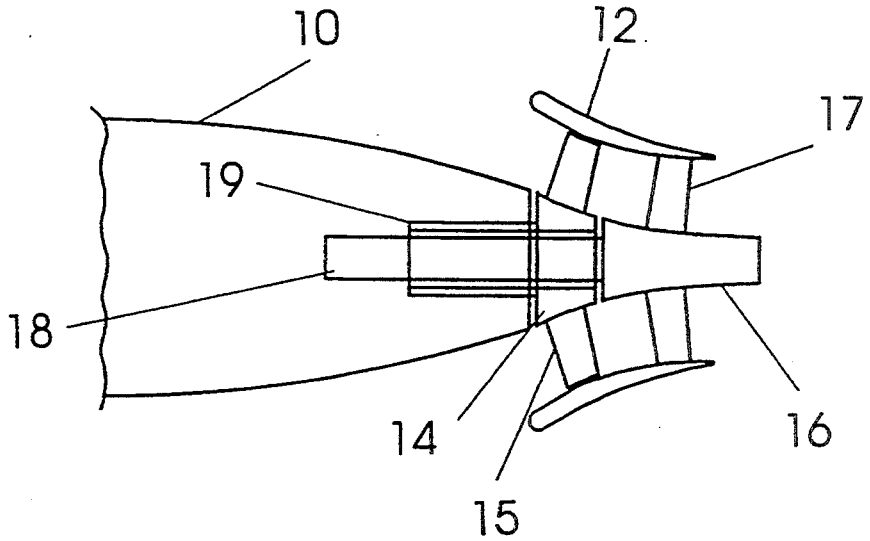

The same reference numbers as in FIG. 1 is used for the same components as for the propulsion device according to the invention, shown in FIG. 2.

The rear part of the torpedo body 10 is equipped with an axle 18 which is rigidly attached at one of its ends to said torpedo body. A hollow rotor drive shaft 19 carries the rotor 15 and is concentrically and rotatable supported on said axle 18. The stator hub 16 is rigidly supported on said axle 18, at the opposite end downstream the rotor 15. The hub 16 supports the stator wings 17, which are supporting the shroud 12.

The shape of the shroud 12 and the stator 16, 17 does not differ considerably in FIG. 2 from the embodiment shown in FIG. 1. However, it is advisable to adapt said forms to a considerably higher range of speed.

Calculations have shown that the emission of noise by the arrangement according to FIG. 2, is essentially much lower than with conventional supports, and in the magnitude of at least 20 dB.

Calculations of the cavitation have shown that the cavitation-free speed at a certain depth can be 2–3 times higher by the arrangement according to FIG. 2. This means that a vessel with a pumpjet system designed according to the present invention, can be propelled very silently at substantially higher speeds than what is possible with a conventional arrangement, since the cavitation normally causes a very high noise-emission. The invention is not limited to the above described embodiment. Instead more variations are conceivable within the scoop of the following claims.

I claim:

1. A propulsion system for water vessels, said propulsion system comprising;

a rotor located at the rear end of a vessel body, said rotor being rotatably mounted inside a circular shroud and connected to means for driving said rotor to generate a propulsion force;

a stator located behind said rotor for recovering the rotation energy created by said rotor;

a hollow rotatable drive shaft on which said rotor is mounted; and an axle extending through said hollow drive shaft and being rigidly attached to the vessel body to support the stator and the shroud that surrounds said rotor.

2. A propulsion system according to claim 1, wherein the only connection between said shroud and said rigidly attached axle, is via the stator.

* * * * *